US010214864B2

(12) United States Patent
Brunninger

(10) Patent No.: US 10,214,864 B2
(45) Date of Patent: Feb. 26, 2019

(54) METHOD FOR STABILIZING AN EARTH FORMATION

(71) Applicant: Plasser & Theurer Export von Bahnbaumaschinen Gesellschaft m.b.H., Vienna (AT)

(72) Inventor: Manfred Brunninger, Altenberg (AT)

(73) Assignee: Plasser & Theurer Export von Vahnbaumaschinen Gesellschaft m.b.H., Vienna (AT)

( * ) Notice: Subject to any disclaimer, the term of this patent is extended or adjusted under 35 U.S.C. 154(b) by 0 days.

(21) Appl. No.: 15/736,368

(22) PCT Filed: Jun. 2, 2016

(86) PCT No.: PCT/EP2016/000906
§ 371 (c)(1),
(2) Date: Dec. 14, 2017

(87) PCT Pub. No.: WO2017/001037
PCT Pub. Date: Jan. 5, 2017

(65) Prior Publication Data

US 2018/0179709 A1 Jun. 28, 2018

(30) Foreign Application Priority Data

Jul. 1, 2015 (AT) ..... A 420/2015

(51) Int. Cl.
*E01B 27/11* (2006.01)
*E01B 27/08* (2006.01)
(Continued)

(52) U.S. Cl.
CPC ..... *E01B 27/08* (2013.01); *E01B 29/00* (2013.01); *E01B 27/06* (2013.01); *E01B 27/11* (2013.01)

(58) Field of Classification Search
CPC ..... E01B 27/06; E01B 27/08; E01B 27/11
See application file for complete search history.

(56) References Cited

U.S. PATENT DOCUMENTS 2,196,205 A * 4/1940 Flynn ..... E01C 21/00 404/133.05
5,511,485 A 4/1996 Romani et al.
(Continued)

FOREIGN PATENT DOCUMENTS

AT 11 972 U1 8/2011
AT 513248 A4 3/2014
(Continued)

OTHER PUBLICATIONS

International Search Report of PCT/EP2016/000906, dated Aug. 22, 2016.

*Primary Examiner* — Sunil Singh
(74) *Attorney, Agent, or Firm* — Collard & Roe, P.C.

(57) ABSTRACT

In a method for stabilizing an earth formation exposed after removal of a track and ballast, in a first working pass in a work section following a rear crawler track with regard to a working direction, parallel to the removal of the ballast the earth formation is loosened up, aggregates are introduced, and grading takes place. In a second working pass, the earth formation to which aggregates have been added is mixed thoroughly by getting picked up by means of a clearing chain and transported onward to a discharge point located behind the rear crawler track and discharged again upon the exposed earth formation, after which, by grading and consolidating the discharged earth formation, a rehabilitation layer is formed.

5 Claims, 1 Drawing Sheet

(51) Int. Cl.
*E01B 29/00* (2006.01)
*E01B 27/06* (2006.01)

(56) References Cited

U.S. PATENT DOCUMENTS

| | | | | |
|---|---|---|---|---|
| 2010/0006307 | A1 | 1/2010 | Jager | |
| 2013/0186656 | A1* | 7/2013 | Theurer | E01B 27/08 171/16 |

FOREIGN PATENT DOCUMENTS

| | | | |
|---|---|---|---|
| DE | 1784659 | A1 | 8/1971 |
| DE | 20 2006 019 143 | U1 | 4/2008 |
| EP | 0 640 719 | A2 | 3/1995 |
| EP | 2 054 552 | B1 | 5/2009 |
| EP | 1 939 355 | B1 | 10/2011 |

* cited by examiner

METHOD FOR STABILIZING AN EARTH FORMATION

CROSS REFERENCE TO RELATED APPLICATIONS

This application is the National Stage of PCT/EP2016/000906 filed on Jun. 2, 2016, which claims priority under 35 U.S.C. § 119 of Austrian Application No. A 420/2015 filed on Jul. 1, 2015, the disclosures of which are incorporated by reference. The international application under PCT article 21(2) was not published in English.

BACKGROUND OF THE INVENTION

The invention relates to a method for stabilizing an earth formation of a track, wherein the earth formation, exposed after removal of the track and ballast, is mixed with aggregates and leveled and consolidated, thus forming a protection layer. The invention also relates to a machine for carrying out the method.

According to AT 513 248, a method for cleaning or renewing ballast of a track is known. The track maintenance machine used for this purpose is supported in the track-less construction site via two crawler tracks. The ballast picked up by a clearing device is cleaned in a screening installation, and a first partial quantity thereof is discharged forward of the front crawler track in the working direction for forming a ballast layer on which the two crawler tracks are riding, thus protecting the earth formation. The remaining ballast quantity is introduced and graded behind the second crawler track for producing an exact ballast formation.

EP 2 054 552 also describes a machine, mobile on crawler tracks, for renewing a ballast bed. First, a base of geotextile or geogrid is laid upon a formation exposed by ballast removal behind the front crawler track rolling on the old ballast bed, on which base a sand layer and on the latter a layer of new ballast is then placed and consolidated. The second crawler track of the machine runs on the new ballast bed thus produced.

SUMMARY OF THE INVENTION

It is the object of the present invention to provide a method and a machine of the type mentioned at the beginning with which improved subgrade rehabilitation is possible.

According to the invention, this object is achieved with a method and a machine of the specified kind by way of the features cited in the characterizing part of the main claim and claim 5, respectively.

A method of this type has the advantage that it is possible to create a rehabilitation layer without the need for a crawler track to travel on the same before its completion, which would lead to an uneven compaction. Thus, an optimal quality of the rehabilitation layer can be guaranteed with relatively little procedural effort.

A machine designed according to the features of claim 5 has the advantage that the structural expense required for rehabilitation of the earth formation is relatively small. Furthermore, machines already in service which are known from the cited prior art and provided for ballast cleaning, can be subsequently retrofitted in a simple manner for an additional application option (or also restored again easily).

BRIEF DESCRIPTION OF THE DRAWINGS

Additional advantages of the invention become apparent from the remaining dependent claims and the drawing description.

The invention will be described in more detail below with reference to an embodiment represented in the drawing.

DETAILED DESCRIPTION

Figure 1:
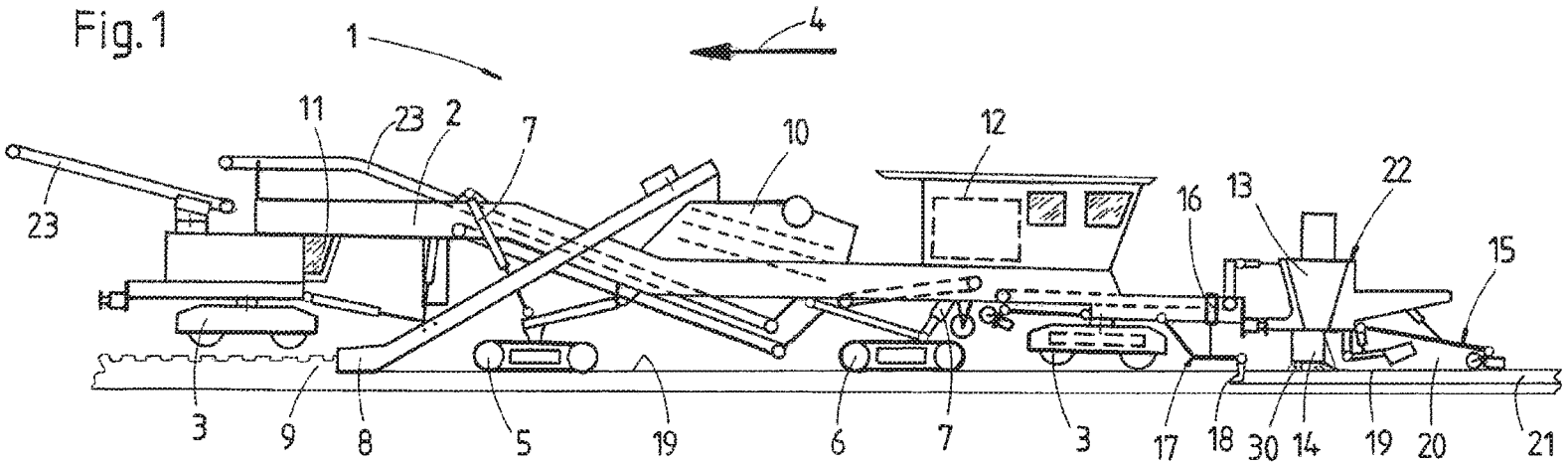
FIGS. 1 and 2 each show a side view of a machine—depicted during two different working passes—for carrying out the method according to the invention.

A machine 1 shown in the drawing, serving for subgrade rehabilitation of a track, has a machine frame 2 which is equipped with two on-track undercarriages 3 arranged at the ends. Between these, a front crawler track 5 and a rear crawler track 6—with regard to a working direction 4—are connected for vertical adjustment via drives 7 to the machine frame 2, on which are additionally provided a clearing chain 8 for picking up ballast 9, a screening installation 10, a work cabin 11, and a motor 12.

At the rear end of the machine frame 2, a discharge device 22 in the shape of a bulk material store 13 having an outlet opening 14 is arranged which is followed, with regard to the working direction 4, by a grading- and consolidating device 15. Located in front of the bulk material store 13 is a scarifying device 17, vertically adjustable by drives 16, which has scarifying teeth 18 spaced from one another in a transverse direction of the machine.

The method, according to the invention, for stabilizing an earth formation 19 of the track commences—after the dismantling of rails and sleepers of the track has taken place—with the removal of the ballast 9 by means of the clearing chain 8 in a first working pass depicted in FIG. 1. During this, the machine 1 is moved continuously by means of the lowered crawler tracks 5 and 6 on the earth formation 19 exposed by the preceding clearing chain 8. The ballast cleaned in the screening installation 10 and the spoil accruing in the process are loaded via conveyor belts 23 for intermediate storage into material wagons (not shown) located on the adjacent track.

Parallel thereto, in a work section 20 adjoining the rear crawler track 6 with respect to the working direction 4, the earth formation 19 is loosened up by means of the scarifying teeth 18 and mixed with aggregates 30 (such as a lime-cement mixture, for example) which are introduced via the outlet opening 14 of the bulk material store 13. Immediately thereafter, the earth formation 19 is leveled by means of the grading- and consolidating device 15 and compacted, thus forming a protection layer 21.

Figure 2:
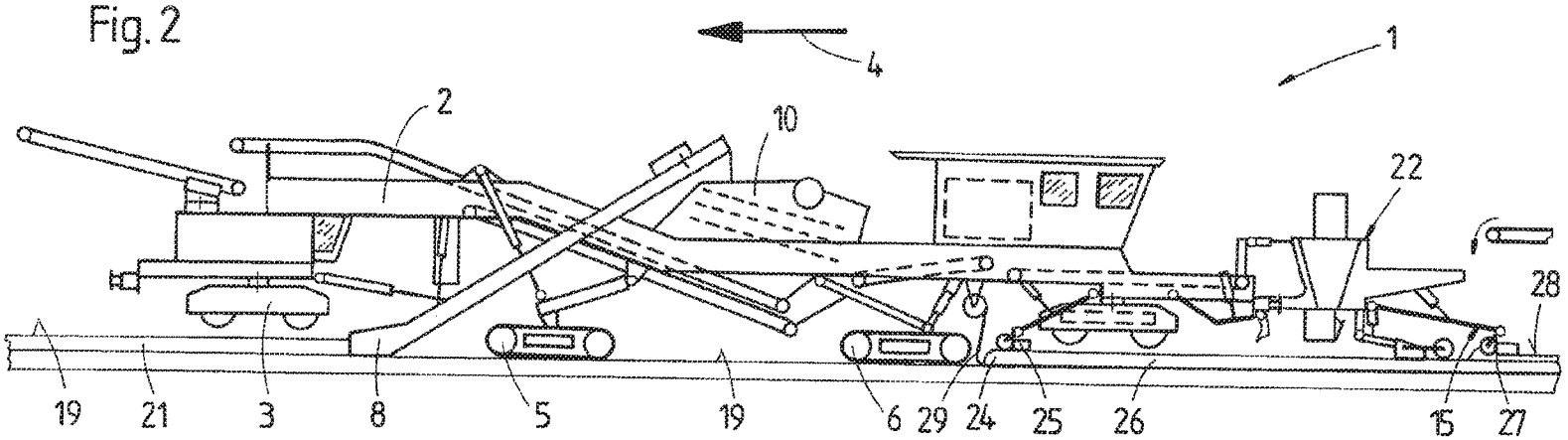

In a second working pass depicted in FIG. 2, the earth formation 19 mixed with the aggregates 30 is now picked up by means of the clearing chain 8 and transported onward via the screening installation 10 to a discharge point 24 located behind the rear crawler track 6. In the process, an advantageous mixing effect takes place which is still enhanced by the vibrating screen of the screening installation 10 over which the material is guided with the aid of a cover plate. The formation material discharged upon the exposed earth formation 19 is graded and consolidated by means of a consolidating device 25, and thus a rehabilitation layer 26 is formed.

In further sequence, gravel 27 can be discharged upon this rehabilitation layer 26, said gravel having been separated out and intermediately stored during the ballast cleaning process as still-usable spoil, and which is now graded to form a protection layer 28, as can be seen in FIG. 2 all the way on the right. Likewise, the ballast 9 picked up by the clearing chain 8 and cleaned in the screening installation 10 can—after the intermediate storage—be discharged, as desired, upon the rehabilitation layer 26 for creating a ballast bed.

In addition, there is also the possibility to place a foil 29 on the rehabilitation layer 26 prior to the discharging of gravel 27.

The invention claimed is:

1. A method for stabilizing an earth formation of a track, wherein the earth formation, exposed after removal of the track and ballast, is mixed with aggregates and leveled and consolidated, thus forming a protection layer, comprising the following features:

a) in a first working pass—in a work section adjoining a rear crawler track with regard to a working direction—parallel to the removal of the ballast the earth formation is loosened up, aggregates are introduced, and grading takes place, b) in a second working pass, the earth formation to which aggregates have been added is mixed thoroughly by getting picked up by means of a clearing chain and being transported onward to a discharge point located behind the rear crawler track and being discharged again upon the exposed earth formation, after which, by grading and consolidating the discharged earth formation, a rehabilitation layer is formed.

2. The method according to claim 1, wherein the ballast picked up in the first working pass is cleaned and gravel, which has been separated out as spoil in the process, is intermediately stored, said gravel being discharged in the second working pass upon the rehabilitation layer and graded to form a protection layer.

3. The method according to claim 2, wherein, prior to the discharging of gravel, a foil is placed upon the rehabilitation layer.

4. The method according to claim 1, wherein the ballast picked up by the clearing chain is cleaned and, after intermediate storage, discharged upon the rehabilitation layer to form a ballast bed.

5. A machine having crawler tracks, a clearing chain for picking up ballast, a screening installation, and a discharge device provided for introducing bulk material, for carrying out a method for stabilizing an earth formation of a track according to claim 1, comprising the following features:

a) behind a rear crawler track—with regard to a working direction of the machine—a bulk material store having a discharge opening for aggregates is arranged as said discharge device, b) arranged in front of the bulk material store are scarifying teeth, spaced from one another in a transverse direction of the machine and vertically adjustable by drives, for loosening up an earth formation, c) behind the bulk material store, with regard to the working direction, a grading- and consolidating device is provided.

* * * * *